US011001052B2

(12) United States Patent
Landenberger

(10) Patent No.: US 11,001,052 B2
(45) Date of Patent: May 11, 2021

(54) APPARATUS FOR ACTUATING A HYDRAULIC CARRIER ROD OF A ROTARY PRINTING MACHINE

(71) Applicant: BOBST BIELEFELD GMBH, Bielefeld (DE)

(72) Inventor: Lorenz Landenberger, Lage (DE)

(73) Assignee: BOBST BIELEFELD GMBH, Bielefeld (DE)

( * ) Notice: Subject to any disclaimer, the term of this patent is extended or adjusted under 35 U.S.C. 154(b) by 141 days.

(21) Appl. No.: 16/302,919

(22) PCT Filed: May 24, 2017

(86) PCT No.: PCT/EP2017/025146
§ 371 (c)(1),
(2) Date: Nov. 19, 2018

(87) PCT Pub. No.: WO2017/202506
PCT Pub. Date: Nov. 30, 2017

(65) Prior Publication Data

US 2019/0152217 A1 May 23, 2019

(30) Foreign Application Priority Data

May 25, 2016 (DE) ..... 202016102779.9

(51) Int. Cl.
*B41F 27/10* (2006.01)
*B41F 30/04* (2006.01)

(52) U.S. Cl.
CPC ..... *B41F 27/105* (2013.01); *B41F 30/04* (2013.01); *B41P 2227/21* (2013.01)

(58) Field of Classification Search
CPC ..... B41P 2227/21; B41F 27/105; B41F 30/04
See application file for complete search history.

(56) References Cited

U.S. PATENT DOCUMENTS 4,386,566 A * 6/1983 Moss ..... B41F 27/105 101/375
6,161,478 A * 12/2000 Katz ..... B41F 13/10 101/368
6,543,356 B2 * 4/2003 Gottling ..... B41F 13/08 101/248
9,579,876 B1 * 2/2017 Maeda ..... B41F 13/10
(Continued)

FOREIGN PATENT DOCUMENTS

DE 202004011420 U1 9/2004
DE 102004037253 A1 9/2006
(Continued)

OTHER PUBLICATIONS

English Translation of EP1745929, EPO (Year: 2007).*
(Continued)

*Primary Examiner* — David H Banh
(74) *Attorney, Agent, or Firm* — Bookoff McAndrews, PLLC

(57) ABSTRACT

The invention is about a convenient way of fixing a sleeve over a mandrel in a press. The sleeve is attached by applying a hydraulic pressure into the mandrel which deforms itself and grips on the sleeve. The pressure is brought by a piston mounted on a screw inside the mandrel, which when tightened increases the pressure and grips the sleeve.

5 Claims, 3 Drawing Sheets

(56) References Cited

U.S. PATENT DOCUMENTS

Figure 1:
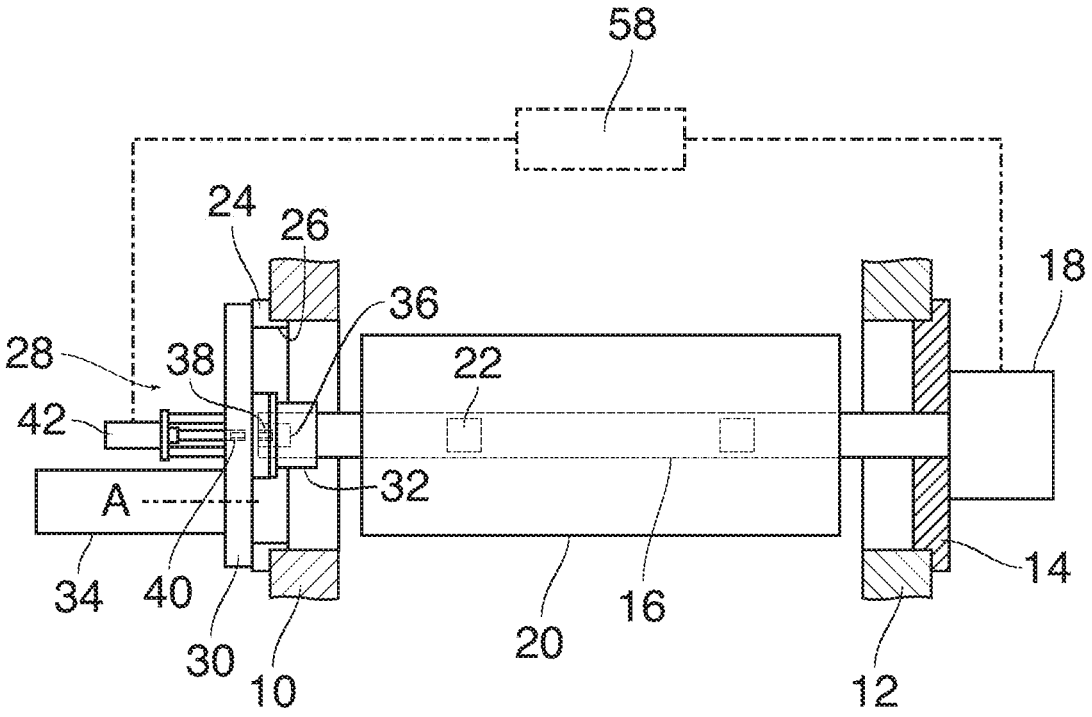

| | | | | |
|---|---|---|---|---|
| 2003/0213389 | A1* | 11/2003 | Kolbe | B41F 27/105 101/382.1 |
| 2004/0079250 | A1* | 4/2004 | Lorig | B41F 27/105 101/375 |
| 2008/0265494 | A1* | 10/2008 | Moriwaki | B65H 31/06 271/207 |
| 2009/0145122 | A1* | 6/2009 | Deeken | F04B 49/002 60/451 |

FOREIGN PATENT DOCUMENTS

| | | | |
|---|---|---|---|
| DE | 102007017097 | A1 | 3/2008 |
| EP | 0 736 382 | A1 | 10/1996 |
| EP | 0769373 | A1 | 4/1997 |
| EP | 1193059 | A1 | 4/2002 |
| EP | 1 362 697 | B1 | 4/2005 |
| EP | 1 745 929 | A1 | 1/2007 |
| JP | 2004-1515 | A | 1/2004 |

OTHER PUBLICATIONS

International Search Report issued in related WO PCT/EP2017/025146 (filed May 24, 2017) (2 pages).

Japanese Patent Office, Notice of Reasons for Refusal in related JP App. No. 2019-513108, dated Sep. 17, 2019, with machine translation (8 total pages).

German Search Report (in German) dated Jan. 30, 20217 in counterpart German Patent Application No. DE202016102779.9U(5 pages).

* cited by examiner

APPARATUS FOR ACTUATING A HYDRAULIC CARRIER ROD OF A ROTARY PRINTING MACHINE

CROSS-REFERENCE TO RELATED APPLICATION(S)

This application is a National Stage under 35 U.S.C. § 371 of International Application No. PCT/EP2017/025146, filed on May 24, 2017, which claims priority to German Patent Application No. 20 2016 102 779.9, filed on May 25, 2016, the contents of all of which are incorporated by reference in their entirety.

The invention relates to a device for actuating a hydraulic carrier rod of a rotary printing machine, which has a rotary drive for the carrier rod, an electronic control device for the rotary drive, and a removable bearing arrangement for supporting one end of the carrier rod, and wherein the carrier rod has a hydraulic clamping system for clamping a cylinder sleeve on the carrier rod and the clamping system has a rotatable actuating member with a coupling for a tool at the end of the carrier rod that is supported in the removable bearing arrangement.

Rotary printing machines are known, for example, from EP 1 362 697 B1, in which exchangeable cylindrical sleeves such as printing cylinder sleeves are pushed onto a carrier rod that is supported in a rotationally driven manner in the frame of the printing machine such that it remains permanently in the frame. In order to fix the cylinder sleeve, the carrier rod has a hydraulic clamping system with which parts of the circumferential wall of the carrier rod can be expanded by hydraulic pressure so that the cylinder sleeve is held clamped on the carrier rod. When the hydraulic pressure is relieved and the bearing arrangement is removed at one end of the carrier rod, the cylindrical sleeve can then be pulled off axially from the carrier rod.

To activate and deactivate the hydraulic clamping system, a rotatable actuating member is provided at the end of the carrier rod. By rotating this actuating member in one direction, the hydraulic fluid is pressurized, and by rotating in the opposite direction the pressure is relieved. The actuating member has a coupling for a tool. This coupling has, for example, the shape of an inner hexagon into which a hexagonal wrench can be inserted.

In conventional printing machines, the clamping system is operated by manually rotating the actuating member with the help of the tool.

The object of the invention is to provide a device that makes it possible to simplify and largely automate the actuation of the clamping system.

This object is achieved according to the invention by the fact that the apparatus has a tool holder with which the tool is held axially movably and rotationally rigidly on the bearing arrangement and that the control device is arranged to control an axial extension movement of the tool holder and thereby bring the tool with the coupling in engagement and activate the rotary drive and thereby rotate the carrier rod relative to the tool.

In the case of the apparatus according to the invention, the tool is thus held rotationally rigidly on the bearing arrangement so that the tool is always at hand at any time. In order to couple the tool to the actuating member, the tool is moved axially in the direction of the actuating member so that it engages with its coupling. According to the invention, the carrier rod is rotated with the fixed tool instead of rotating the tool. For this purpose, the already provided rotary drive is used. The extension movement of the tool holder and the rotation of the carrier rod are controlled by the electronic control device so that the work sequences are largely automatic.

Advantageous embodiments and further developments are specified in subordinate claims.

In an advantageous embodiment, the control device, as known per se, is designed such that it can also measure the torque exerted by the rotary drive on the carrier rod. When the clamping system is actuated, this function also allows counter torque to be measured, which the actuating member held by the tool exerts on the carrier rod. This makes it possible to dose precisely the actuating force exerted on the actuating member and thus the pressure in the hydraulic system.

Alternatively or additionally, the angle of rotation by which the carrier rod is rotated, by means of the rotary drive, can also be measured. This makes it possible, for example, to return the actuating member to a precisely defined starting position when the clamping system is relieved.

In the following, an exemplary embodiment is explained in more detail with reference to the drawing.

Figure 2:
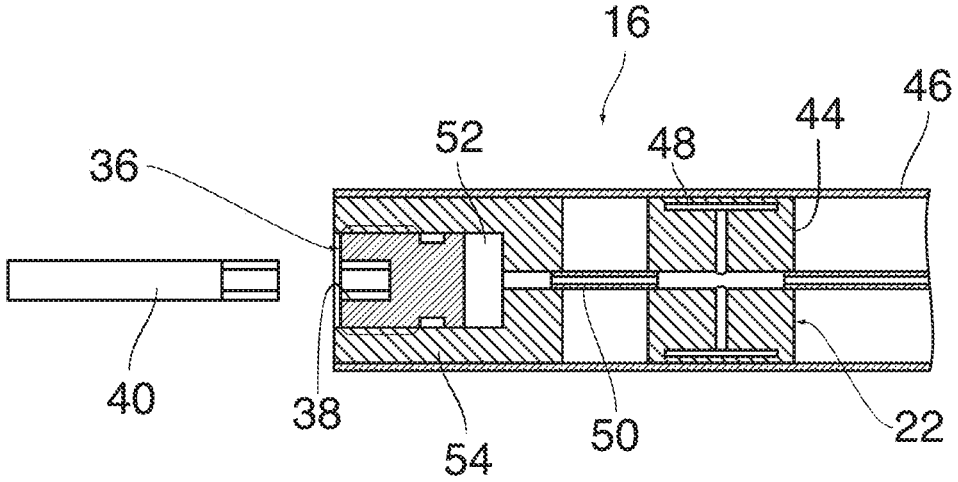
Figure 3:
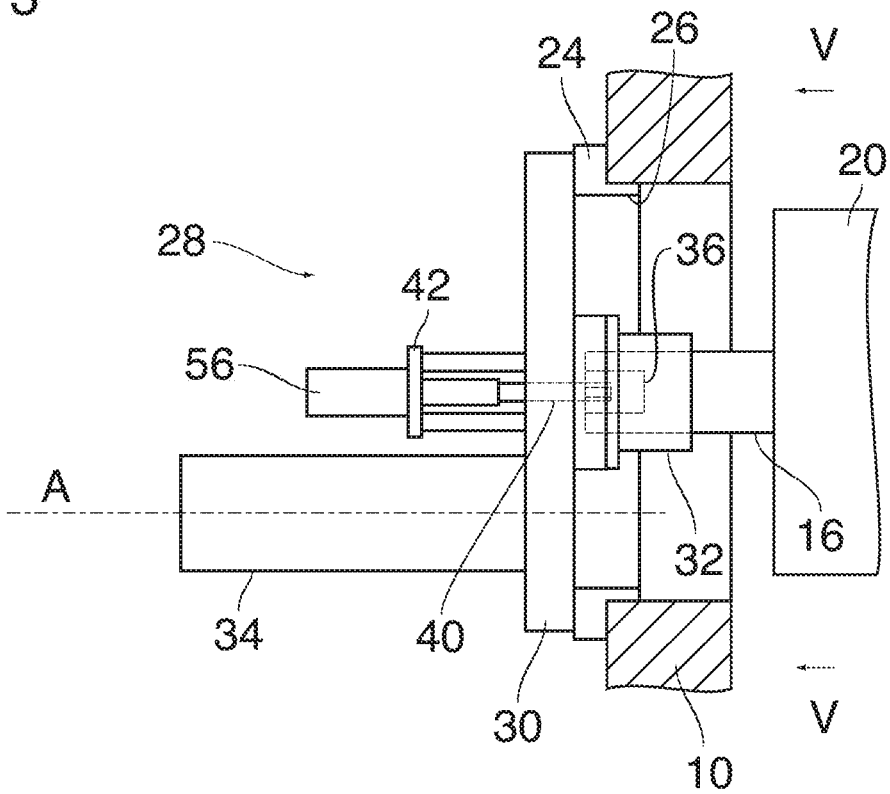
Figure 4:
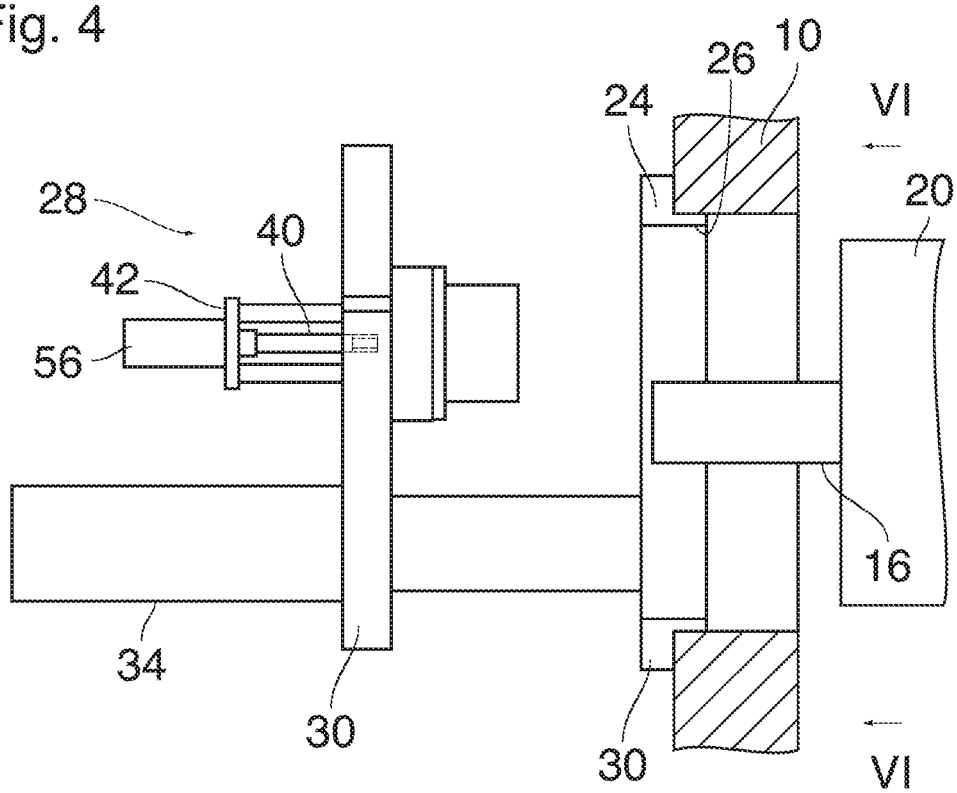
Figure 5:
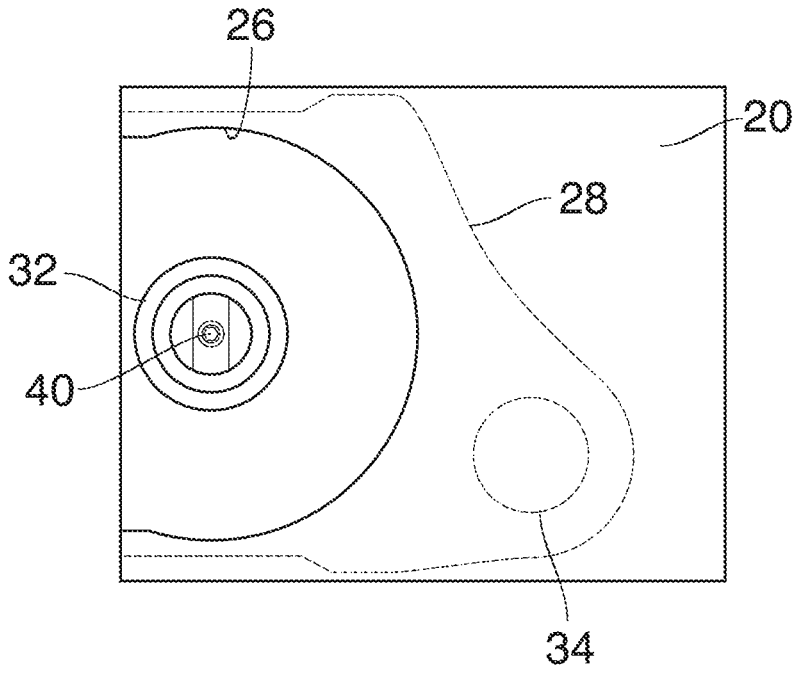
Figure 6:
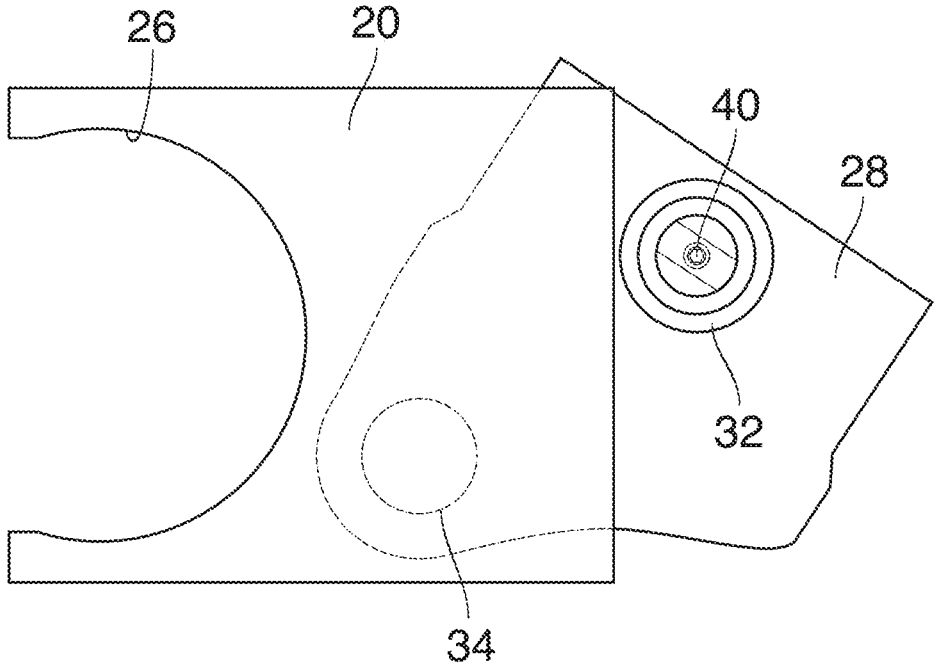

Shown are:

FIG. 1 a view of a cylinder sleeve that is mounted on a carrier rod and mounted in a rotatable manner in a printing machine;

FIG. 2 an axial section through one end of the carrier rod;

FIG. 3 a view of a bearing arrangement at one end of the carrier rod;

FIG. 4 a view of the bearing arrangement in a position in which the cylinder sleeve can be pulled off from the carrier rod;

FIG. 5 an inside view of the bearing arrangement in the state according to FIG. 3, from the direction of the arrows V-V in FIG. 3; and FIG. 6 shows an inside view of the bearing arrangement in the state according to FIG. 4, from the direction of the arrows VI-VI in FIG. 4.

In FIG. 1 two side parts 10, 12 of a frame of a rotary printing machine are shown in a partial section. In FIG. 1, the right side part 12 carries a bearing block 14 in which a carrier rod 16 is supported in such a way that it protrudes like a cantilever towards the opposite side part 10. A rotary drive 18 is arranged, on the outside of the bearing block 14, by means of which the carrier rod 16 can be rotated. The carrier rod 16 holds a cylinder sleeve 20 that is braced on the carrier rod by means of a hydraulic clamping system 22 and thus it can also be rotated by means of the rotary drive 18. On the left side part 10 in FIG. 1, a bearing block 24 is arranged which has a removal opening 26 that is dimensioned such that it allows the passage of the cylinder sleeve 20. A removable bearing arrangement 28 is held on the bearing block 24. This bearing arrangement 28 has a base plate 30 that, in the state shown in FIG. 1, closes the removal opening 26 and on the inside it holds a bearing 32 for the respective end of the carrier rod 16. A drive unit 34 allows the bearing arrangement 28 to be pulled off axially from the bearing block 24 and to pivot it about a pivoting axis A into a position in which it opens the removal opening 26 so that the cylinder sleeve 20 can be pulled off the carrier rod 16 after the hydraulic clamping system 22 has been deactivated.

To activate and deactivate the hydraulic clamping system, an actuating member 36 is arranged at the end of the carrier rod 16 accommodated in the bearing 32, which can be rotated relative to the carrier rod 16 in order to pressurize the hydraulic fluid in the hydraulic clamping system 22. On the face side that faces the base plate 30 of the bearing arrangement 28, the actuating member 36 has a coupling 38, for example, in the form of an inner hexagon, for a tool 40. The tool 40, which has an outer hexagon complementary to the coupling 38, is held axially movably and rotationally rigidly on the base plate 30 by means of a tool holder 42.

In FIG. 1, the tool holder 42 is shown in a position in which it holds the tool 40 remotely in a position from the coupling 38. In this state, the unit formed by the carrier rod 16 and the cylinder sleeve 20 can thus be set in rotation by means of the rotary drive 18.

In FIG. 2, the end of the carrier rod 16, on which the actuating member is located, is shown in a magnified axial section. The hydraulic clamping system 22 is formed by a plurality of hydraulic bushes 44 that support a circumferential wall 46 of the carrier rod from within. Each hydraulic bushing has an annular chamber 48 within its outer circumferential wall and that is connected to a pressure chamber 52 filled with hydraulic fluid via a hydraulic line 50. The pressure chamber 52 is formed in the plug 54 inserted into the end of the carrier rod 16, which also accommodates the actuating member 36. The actuating member 36 has the form of a screw done into the plug 54 and at the same time forms a piston that limits the pressure chamber 52. When the actuating member 36 is screwed deeper into the plug 54 by means of the tool 40, the hydraulic fluid in the pressure chamber 52, the hydraulic line 50 and the annular chambers 48 is thus compressed. The result is that the hydraulic bushes and the zones of the circumferential wall 46 of the carrier rod 16 supported by them expand elastically. The circumferential wall 46 of the carrier rod is thereby firmly clamped against the inner circumferential surface of the cylinder sleeve 20. When the actuating member 36 is rotated in the counter-clockwise direction, the hydraulic fluid is relieved and thereby the cylinder sleeve 20 is released so that it can be pulled off axially from the carrier rod 16.

In FIG. 3, the bearing arrangement 28 is shown in a magnified scale. The tool holder 42 has a pneumatic cylinder 56 that is centred in the state shown in FIGS. 1 and 3 on the axis of the carrier rod 16 and it can be axially extended, by means of the tool 40, so that its outer hexagon engages with the coupling of the actuating member 36, as shown in FIG. 3.

If now the cylinder sleeve 20 is to be released from the carrier rod 16, the hydraulic clamping system 22 must first be relieved. For this purpose, the carrier rod 16 and the cylinder sleeve 20 are rotated with the help of the rotary drive 18 such that the actuating member 36, which is held rotationally rigidly by the tool 40, is screwed out of the plug 54 so that the volume of the pressure chamber 52 increases and the hydraulic pressure decreases accordingly. The tool 40 is then pulled back, by means of the pneumatic cylinder 56, into the disengaged position.

Subsequently, by means of the drive unit 34, the entire bearing arrangement 28 is moved axially away from the bearing block 24. The bearing 32 is pulled off from the end of the carrier rod 16. Thereafter, the bearing arrangement 28 is pivoted about the pivoting axis A into the position shown in FIGS. 4 and 6, by means of the drive unit 24, in which it releases the removal opening 26 so that the cylinder sleeve 20 can be removed.

By reversing the movement sequences described above, a new cylinder sleeve can be mounted on the carrier rod 16. If the bearing arrangement 28 is pivoted back into the position shown in FIGS. 3 and 5, the bearing 32 and also the tool 40 will again be centred on the axis of the carrier rod, and thus on the coupling 38 of the actuating element 36.

When the tool is extended again in the direction of the actuating member 36 by means of the pneumatic cylinder 56, it can happen that the outer hexagon of the tool and the inner hexagon of the coupling 38 are rotated relative to one another so that the tool cannot engage immediately. However, when the carrier rod and thus also the actuating member 36 are then rotated with the help of the rotary drive 18, then, as it is held under elastic bias by the pneumatic cylinder, the tool 40 automatically locks as soon as the correct angular position is reached. During further rotation of the carrier rod, the actuating member 36 is then screwed deeper and thus the hydraulic system is pressurised again.

In FIG. 1, an electronic control device 58 of the printing machine is shown schematically. This control device also controls, inter alia, the function of the rotary drive 18 as well as the function of the pneumatic cylinder 56 of the tool holder so that the above-described movement sequences can be coordinated and controlled by the control device 58.

The rotary drive 18 usually contains an integrated angle incremental encoder, with which the angular position of the carrier rod can be measured. The angular position is fed back to the control device 58. In this way, it can be ensured that the actuating member 36 is always rotated by the same angle, so that the hydraulic pressure in the clamping system 22 can be maintained at the predetermined value with high precision.

In an advantageous embodiment, the control device 58 is also able to measure the torque actually exerted by the rotary drive in a known manner, for example, by means of the current consumption of the rotary drive 18. In this case, the control device can also operate in such a way that, upon tensioning of the clamping system, the rotary movement terminates as soon as the torque has reached a certain threshold value.

As far as the unscrewing movement of the actuating member 36 is also limited by a stop (not shown here), the unscrewing movement can be terminated as soon as the torque reaches a certain threshold value even when the clamping system is released. Otherwise, it is ensured based on the data from the angle incremental encoder that the actuating member 36 is brought into a defined neutral position when the clamping system is released.

The invention claimed is:

1. A hydraulic carrier rod of a rotary printing machine in combination with an apparatus for actuating the hydraulic carrier rod, the apparatus comprising a rotary drive for the carrier rod;

an electronic control device for the rotary drive; and a removable bearing arrangement for supporting one end of the carrier rod, wherein the carrier rod has a hydraulic clamping system for clamping a cylinder sleeve pushed onto the carrier rod, the hydraulic clamping system has a rotatable actuating member at the one end of the carrier rod, the rotatable actuating member is mounted in the removable bearing arrangement and includes a coupling for a tool, the hydraulic clamping system includes a plurality of hydraulic bushes, each of the plurality of hydraulic bushes has an annular chamber within a circumferential wall of the carrier rod, the annular chamber is connected to a pressure chamber and fillable with a hydraulic fluid, the removable bearing arrangement includes a tool holder, the tool holder holds the tool axially movably and rotationally rigidly on the removable bearing arrangement, the electronic control device is configured to:

control an axial extension movement of the tool holder and thereby to engage the tool with the coupling, and activate the rotary drive to thereby rotate the carrier rod relatively to the tool, and the electronic control device is further configured to:

rotate the carrier rod to a defined angle relative to the rotatable actuating member held by the tool when clamping and/or relieving the hydraulic clamping system, and/or monitor a torque generated by the rotary drive and, when the clamping and/or the relieving the hydraulic clamping system, terminate rotation of the carrier rod as soon as the torque reaches a predetermined threshold value.

2. The apparatus of claim 1, wherein the tool holder comprises a pneumatic cylinder for extending and retracting the tool.

3. A hydraulic carrier rod of a rotary printing machine in combination with an apparatus for actuating the hydraulic carrier rod, the apparatus comprising a rotary drive for the carrier rod;

an electronic control device for the rotary drive; and a removable bearing arrangement for supporting one end of the carrier rod, wherein the carrier rod has a hydraulic clamping system for clamping a cylinder sleeve pushed onto the carrier rod, the hydraulic clamping system has a rotatable actuating member at the one end of the carrier rod, the rotatable actuating member is mounted in the removable bearing arrangement and includes a coupling for a tool, the hydraulic clamping system includes a plurality of hydraulic bushes, each of the plurality of hydraulic bushes has an annular chamber within a circumferential wall of the carrier rod, the annular chamber is connected to a pressure chamber and fillable with a hydraulic fluid, the removable bearing arrangement includes a tool holder, the tool holder holds the tool axially movably and rotationally rigidly on the removable bearing arrangement, and the electronic control device is configured to:

control an axial extension movement of the tool holder and thereby to engage the tool with the coupling, activate the rotary drive to thereby rotate the carrier rod relatively to the tool, monitor a torque generated by the rotary drive, and, when clamping and/or relieving the hydraulic clamping system, terminate rotation of the carrier rod as soon as the torque reaches a predetermined threshold value.

4. A hydraulic carrier rod of a rotary printing machine in combination with an apparatus for actuating the hydraulic carrier rod, the apparatus comprising:

a rotary drive for the carrier rod;

an electronic control device for the rotary drive; and a removable bearing arrangement for supporting one end of the carrier rod, wherein the carrier rod has a hydraulic clamping system for clamping a cylinder sleeve pushed onto the carrier rod, the hydraulic clamping system has a rotatable actuating member at the one end of the carrier rod, the rotatable actuating member is mounted in the removable bearing arrangement and includes a coupling for a tool, the hydraulic clamping system includes a plurality of hydraulic bushes, each of the plurality of hydraulic bushes has an annular chamber within a circumferential wall of the carrier rod, the rotatable actuating member includes a screw, the carrier rod includes a plug on the one end of the carrier rod, the plug includes a pressure chamber, the screw goes into/out of the plug on the one end of the carrier rod to compress/decompress the pressure chamber, the removable bearing arrangement includes a tool holder, the tool holder holds the tool axially movably and rotationally rigidly on the removable bearing arrangement, and the electronic control device is configured to:

control an axial extension movement of the tool holder and thereby to engage the tool with the coupling, activate the rotary drive to thereby rotate the carrier rod relatively to the tool, monitor a torque generated by the rotary drive, and, when clamping and/or relieving the hydraulic clamping system, terminate rotation of the carrier rod as soon as the torque reaches a predetermined threshold value.

5. The apparatus of claim 4, wherein, when compressing the pressure chamber, the hydraulic fluid in the pressure chamber and the annular chamber is compressed so that the plurality of hydraulic bushes and the circumferential wall of the carrier rod expand elastically, thereby clamping the circumferential wall against an inner circumferential surface of the cylinder sleeve.

* * * * *